United States Patent [19]

Paque

[11] 4,415,395

[45] Nov. 15, 1983

[54] APPARATUS FOR APPLYING A PRINTING OR CUTTING FORCE TO A LAMINATED TAPE

[75] Inventor: Michael W. Paque, Scottsdale, Ariz.

[73] Assignee: Kroy Inc., St. Paul, Minn.

[21] Appl. No.: 339,482

[22] Filed: Jan. 15, 1982

[51] Int. Cl.[3] ..... B30B 15/02; B30B 15/04

[52] U.S. Cl. ..... 156/384; 83/510; 100/98 R; 101/22; 101/33; 101/112; 156/248; 156/510; 156/540; 156/579; 156/581; 400/48

[58] Field of Search ..... 156/238, 234, 233, 384, 156/385, 510, 515, 518, 520, 528, 579, 580, 581, 248, 249, 540; 101/19, 22, 33, 34, 112, 30; 100/97, 98 R; 83/510, 511; 400/48, 654

[56] References Cited

U.S. PATENT DOCUMENTS

| | | | |
|---|---|---|---|
| 2,357,310 | 9/1944 | Burchell | 156/510 |
| 2,737,238 | 3/1956 | Rowlands | 83/510 |
| 2,776,610 | 1/1957 | Roselius | 83/510 |
| 3,937,645 | 2/1976 | Ascoli et al. | 156/581 |
| 3,953,280 | 4/1976 | Brophy et al. | 156/581 |
| 4,108,556 | 8/1978 | Connoy | 400/48 |

*Primary Examiner*—Michael G. Wityshyn
*Attorney, Agent, or Firm*—Dorsey & Whitney

[57] ABSTRACT

An apparatus for applying a printing or cutting force to an elongated strip of tape comprising a base, a printing station, a pair of side walls extending upwardly from the base and each including a tape receiving opening, a printing or cutting member and a force exerting element. The force exerting element includes a curved force exerting surface with the axis of its center of curvature being parallel to the path of travel of tape through the apparatus and a structure for supporting and guiding the force exerting element in movement between a first and second position.

24 Claims, 14 Drawing Figures

APPARATUS FOR APPLYING A PRINTING OR CUTTING FORCE TO A LAMINATED TAPE

BACKGROUND OF THE INVENTION

The present invention relates generally to an apparatus for generating a printing or cutting force, and more particularly, to an apparatus useful in conjunction with a multi-layer tape, a lettering chip and force resisting means for generating a force sufficient to print a character onto or cut a character from at least one layer of a multi-layer tape.

The prior art shows several different mechanisms for generating a force sufficient to print an image onto or cut an image from a multi-layer tape. For example, in U.S. Pat. No. 3,558,425 to B. J. Massari, a laminated tape is fed between a pair of pressure rollers to create the force necessary for cutting the laminated tape. In the embodiment illustrated in the aforementioned Massari patent, a die with a raised cutting edge is aligned, together with a multi-layer tape, between the pair of pressure rollers so that the force provided by the rollers causes the cutting edge of the die to cut through the desired layers of the multi-layer tape.

In U.S. Pat. No. 4,108,556, a printing force is generated through the use of a generally wedge-shaped element cooperating in rolling engagement with a force resisting means. In this patent, a printing force is applied to a lettering chip onto a multi-layed tape to transfer an image from one layer of the tape to another. In the embodiment of the above-identified patent, the force from the wedge-shaped roller mechanism is applied in the longitudinal direction of the elongated tape. Although this device functions satisfactorily in certain applications, it has several limitations. For example, the rolling movement of the wedge shaped roller is in the longitudinal direction of the laminated tape. This makes it difficult to view the printing results from the side of the laminated tape adjacent to the roller. Because of this, the device in this patent provides means for reviewing the printing results from the side of the laminated tape opposite the roller. Accordingly, a need exists in the art for a force exerting apparatus in which the operator can readily view the character cut or printed immediately after each such operation and on the side of the tape adjacent to the force exerting mechanism.

SUMMARY OF THE INVENTION

The present invention relates to an improved apparatus for generating a force sufficient to print or cut a character image from a lettering chip or the like onto or from an elongated section of laminated tape. This apparatus contemplates the use of a wedge shaped roller and includes a structure which facilitates observation of the printed or cut character on the side of the laminated tape adjacent to the force generating means.

More specifically, the present apparatus includes a force resisting base, a pair of parallel side walls extending upwardly from the base and a generally wedge-shaped roller section having a curved force exerting surface and a handle for manually applying a printing or cutting force to a section of laminated tape. The side walls each include an elongated slot generally parallel to the printing or cutting surface for insertion of the elongated section of laminated tape into alignment with the printing or cutting station. Means is also provided between the side walls for supporting a wedge-shaped roller section for rolling movement along a path generally perpendicular to the movement of the elongated laminated tape and through the apparatus. Means are also provided in the form of a pair of grooves in each of the side walls to support and guide the wedge shaped roller in force exerting movement. In the preferred embodiment, means are also provided for limiting the forward movement of the force exerting mechanism to a position in which it is still in a force exerting position and for allowing movement of such mechanism following completion of a printing or cutting cycle to a position rearward of a force exerting position. An improved means is also provided in the apparatus for appropriately positioning and aligning the printing chip within the printing or cutting apparatus and for guiding and aligning the laminated tape.

Accordingly, it is an object of the present invention to provide an improved force exerting apparatus for generating a force sufficient to cut or print an image onto or from an elongated section of laminated tape.

Another object of the present invention is to provide an improved apparatus of the type described above which facilitates improved viewing of the characters previously printed or cut.

A further object of the present invention is to provide an improved apparatus of the type described above with improved means for aligning the printing or cutting chip with respect to the printing or cutting station and for guiding and aligning the laminated tape.

Another object of the present invention is to provide an improved apparatus of the type described above in which the force is provided by a wedge shaped roller moving in a path generally perpendicular to the elongated section of laminated tape.

These and other objects of the present invention will become apparent with reference to the drawings, the description of the preferred embodiment and the appended claims.

DESCRIPTION OF THE PREFERRED EMBODIMENT

Figure 1:
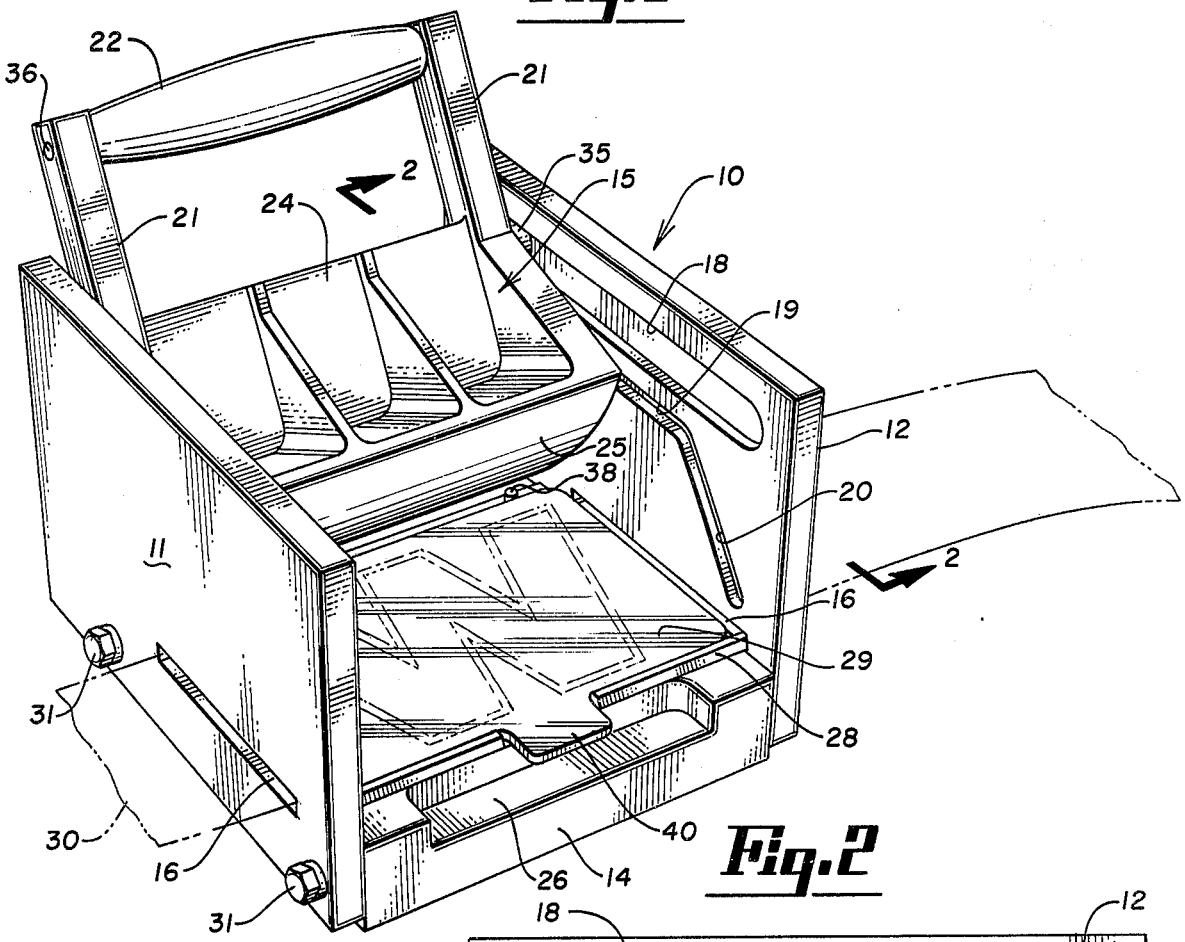
FIG. 1 is a pictorial view of the printing or cutting apparatus of the present invention.

The apparatus of the present invention is illustrated in FIG. 1 by the reference numeral 10. In general, the apparatus 10 includes a base section 14, a pair of parallel, upwardly extending side wall sections 11 and 12 and a generally wedge-shaped force exerting element 15. The element 15 has a curved force exerting surface 25 for exerting a printing or cutting force at a printing or cutting station. The printing or cutting station is defined by a printing or cutting pad 28 affixed to the base 14. The apparatus 10 functions to exert a printing or cutting force with respect to a section of elongated multi-layer or laminated tape 30 positionable in alignment with the printing or cutting station.

Figure 8:
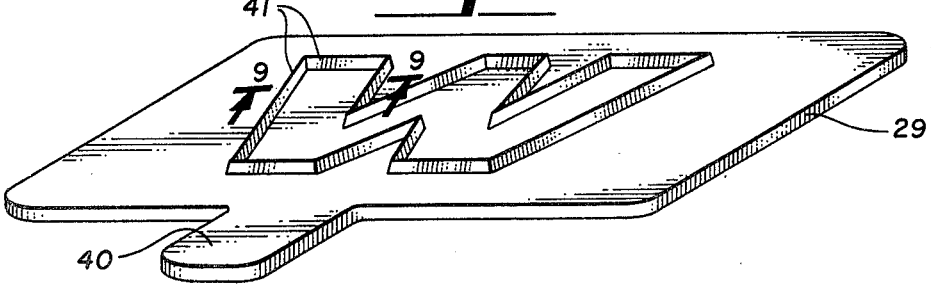
FIG. 8 is a pictorial view of a printing or cutting chip usable with the apparatus of the present invention.

More specifically, as shown in FIGS. 1, 3, 5, 6 and 7, the base 14 comprises a generally rectangular shaped plate member having a flat upper surface. In the preferred embodiment, the base 14 is designed to be supported on a table or other flat supporting means, although it is contemplated that the base 14 could also be hand held or supported by some other means. The top forward edge of the base 14 includes a recessed portion 26 to facilitate the insertion and removal of a printing or cutting chip 29 (FIG. 8). The base 14 may be solid or may include hollowed out sections on its underside to minimize its weight. In the preferred embodiment the base 14 is constructed of aluminum.

Figure 5:
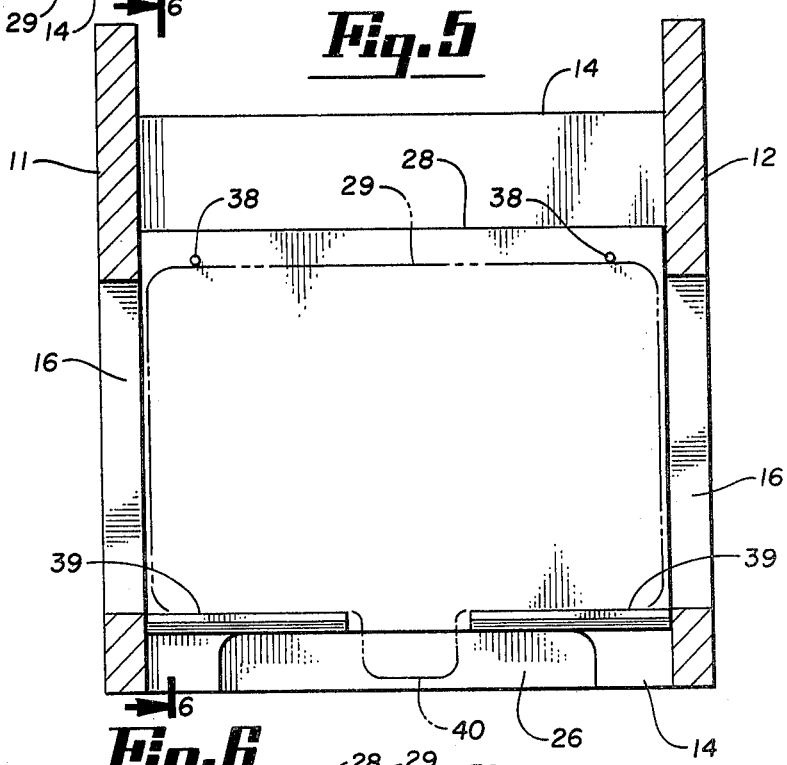
FIG. 5 is a top elevational view, partially in section, of the printing or cutting station as viewed along the line 5—5 of FIG. 3 with the roller removed.
Figure 6:
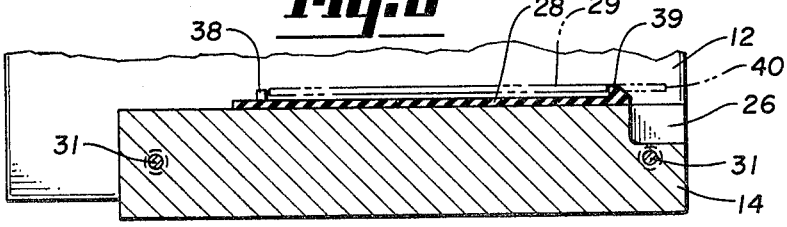
FIG. 6 is a view, partially in section, as viewed along the section line 6—6 of FIG. 5.

In one embodiment, a printing or cutting pad 28 is secured to the flat top surface of the base 14 to define a printing or cutting station. As shown best in FIGS. 5 and 6, the pad 28 has a generally rectangular configuration with its side edges being in general alignment with the side edges of the base 14, but with its forward to rearward dimension being somewhat less than the forward to rearward dimension of the base 14. Specifically, the forward edge of the pad 28 defined by the raised alignment or registration rib 39 is spaced rearwardly from both the front edge of the base 14 as well as the recessed portion 26. The rearward edge of the pad 28 is spaced forwardly from the rearward edge of the base 14. As illustrated best in FIG. 6, the alignment rib 39 includes a portion extending above the primary printing or cutting surface of the pad 28 to retain the printing or cutting chip 29 as will be described in greater detail below. As shown in FIG. 5, the rib 39 includes a pair of sections separated by a recessed section to receive a forward tab 40 of the printing or cutting chip 29. The rearward end of the printing pad 28 includes a pair of alignment or registration posts 38, 38. These alignment posts 38, 38 are embedded within the pad 28 and in the preferred embodiment comprise a pair of steel pins. The purpose of the posts 38, 38 is to assist in proper alignment of the printing and cutting chip 29 during a printing or cutting operation. In the preferred embodiment, the height of the pins 38, 38 above the upper surface of the pad 28 is slightly less than the thickness of the chip 29. Although the pad 28 can be constructed from a variety of materials, the preferred embodiment contemplates the pad 28 being constructed from a urethane material with a hardness of 55–65 Shore D.

Figure 9:
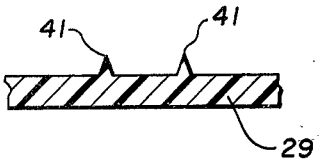
FIG. 9 is a cross-sectional view as viewed along the section line 9—9 of FIG. 8

The printing or cutting chip 29 is best illustrated in FIGS. 8 and 9. As shown, the chip 29 is a generally rectangular element having a tab 40 extending from its forward edge. Each chip 29 includes the configuration of a character on its face which is defined either by a raised surface or by a raised cutting edge. In the preferred embodiment illustrated in FIGS. 8 and 9, the chip 29 is a cutting chip having a raised cutting ridge 41. This ridge 41 defines the outline of a particular character such as a letter of the alphabet. As shown in FIG. 9, the cutting ridge 41 has a generally triangular shaped cross section and terminates in a relatively sharp cutting edge. Although not illustrated, the chip 29 can also include alignment indicia to assist in the alignment of the tape during a printing or cutting operation. In the preferred embodiment, the cutting chip 29 is constructed of a high impact acrylic plastic such as Plexiglass DR 61K manufactured by Rohm & Haas Company of Philadelphia, Pa. During operation, a chip 29 is aligned with respect to the printing or cutting pad 28 in the manner illustrated in FIGS. 5 and 6 with the cutting ridge 41 facing the pad 28. As shown, the dimensions of the chip 29 permit the chip to be aligned between the side walls 11 and 12 and between the registration rib 39 and the alignment posts 38, 38. The tab 40 is received by and extends through the recessed area between the chip sections of the registration rib 39. As also illustrated in FIG. 5, the tab 40 extends past a portion of the recessed area 26 to facilitate easy manual gripping for insertion and removal.

Figure 2:
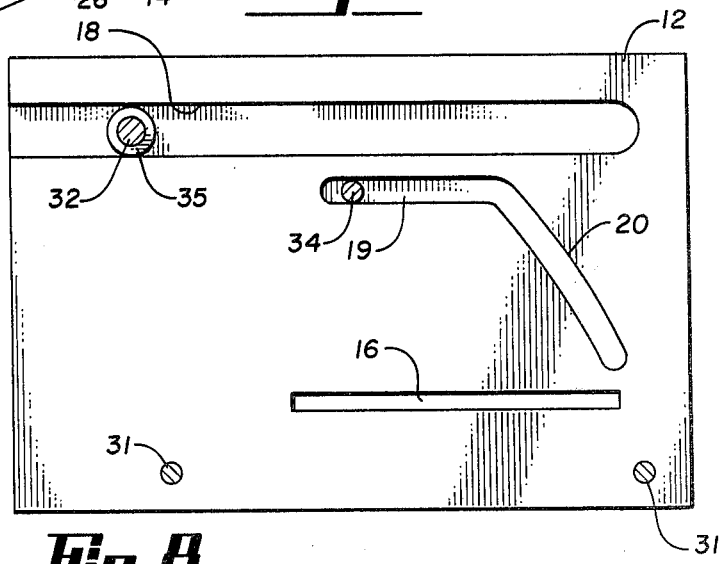
FIG. 2 is a view, partially in section, of one of the side walls of the apparatus as veiwed along the line 2—2 of FIG. 1.
Figure 7:
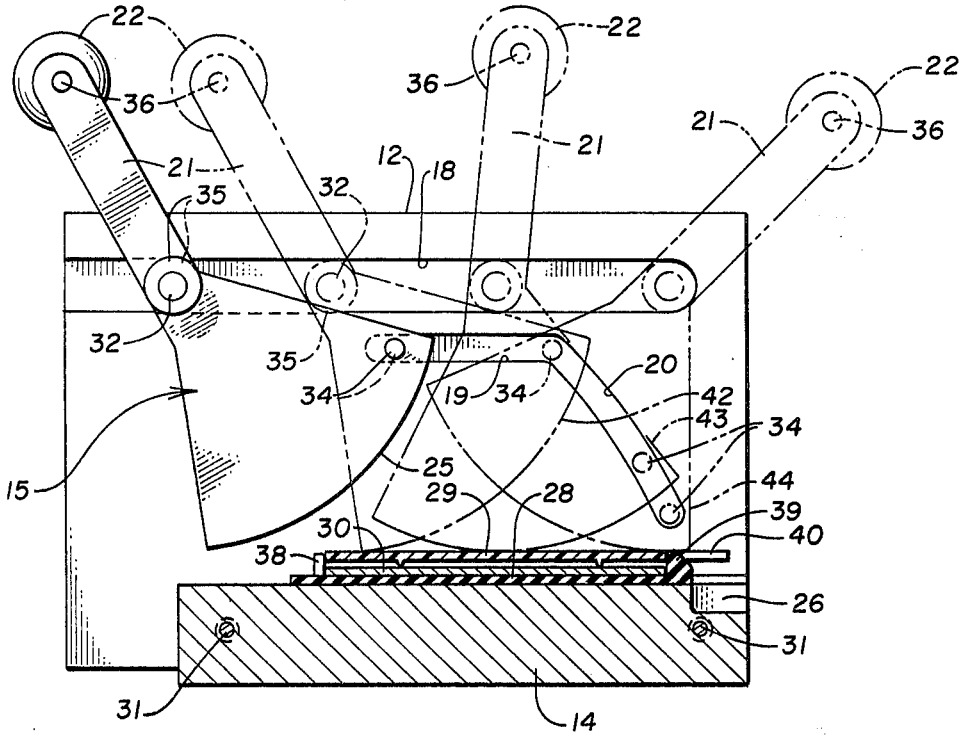
FIG. 7 is a view, partially in section, showing various positions of the roller section during a printing or cutting cycle.

With reference next to FIGS. 1, 2, and 7, the side wall sections 11 and 12 are secured in fixed relationship at their lower edges to a side edge of the base 14 by a pair of threaded members 31, 31. The side walls 11 and 12 are secured such that they extend upwardly from the top surface of the base 14 at right angles and are disposed in generally parallel relationship with respect to one another. Each of the side walls 11 and 12 includes an elongated tape receiving slot 16 positioned so that it is in general alignment with the printing station. In the preferred embodiment, the length of the slot 16 approximates the width of the maximum size of laminated tape 30 to be utilized. Thus, the slot 16 permits insertion of the tape 30 into the force exerting apparatus.

Each of the side wall sections 11 and 12 further includes an elongated roller support slot 18 and a roller guide slot comprising the slot sections 19 and 20. The slot 18 is disposed on the inner surface of the side walls 11 and 12 and is designed to guide and support a roller member 35 (FIGS. 3 and 4) during a printing or cutting operation . The slot 18 is generally parallel to the printing or cutting station and thus also parallel to the top surface of the base 14. The width of the slot 18 approximates the outer diameter of the roller member 35 (FIGS. 3 and 4) with enough tolerance to permit rolling movement of the roller 35 along the length of the elongated slot 18. As shown best in FIG. 2, the slot 18 includes a rearward end (toward the left as viewed in FIG. 2) and a forward end (positioned to the right as viewed in FIG. 2).When the roller 35 is at the rearward end of the slot 18, the force exerting element 15 is in its rearwardmost position and when the roller 35 is at the forward end of the slot 18 the element 15 is at its forwardmost position.

Each of the side wall sections 11 and 12 also includes a pair of slot or groove sections 19 and 20 for guiding the force exerting element 15 in rolling movement with respect to the printing station. As illustrated best in FIG. 2, these slot or groove sections include a section 19 generally parallel to the slot 18 and also generally parallel to the top surface of the base 14 and a section 20 curving forwardly and downwardly from the section 19. The slot sections 19 and 20 are adapted to receive a guide pin 34 (FIGS. 3 and 4) secured to a portion of the force exerting element 15 to guide the same in rolling movement. The horizontal section 19 of the slot includes a rearward end (the end toward the left as viewed in FIG. 2). This rearward end also defines the rearward position of the force exerting element 15. The horizontal section 19 functions primarily to facilitate movement of the force exerting element 15 out of rolling engagement with the printing station so that the chip element 29 can be inserted or removed and the tape 30 advanced prior to the next printing or cutting operation.

Figure 4:
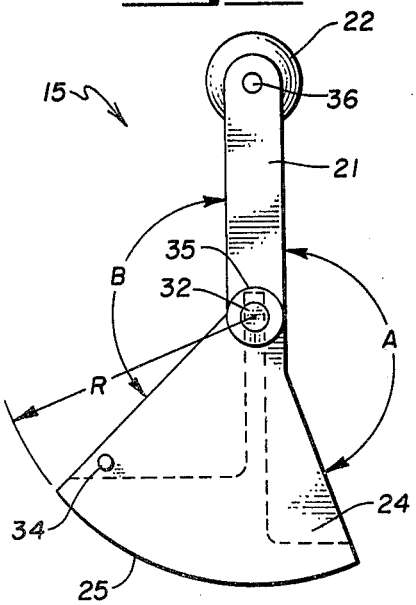
FIG. 4 is a side elevational view of the wedge-shaped force exerting roller of the present invention.

The forward or curved section 20 of the slot functions to guide the force exerting element 15 in rolling, force exerting movement with respect to the printing station. The forward and lower end of the slot section 20 (positioned to the right as viewed in FIG. 2) defines and limits the forward rolling movement of the element 15. As will be described in greater detail below, this limiting position permits the element 15 to be maintained in force exerting engagement with the printing station. Thus, when the force exerting element 15 reaches its forwardmost position as defined by the forward ends of the slot 18 and the slot section 20, it is still in a force exerting position. The specific shape of the section 20 defines the movement of the pin 34 (FIG. 4) on the element 15 as the element 15 moves in true rolling relationship with respect to the printing or cutting station. Similar to the slot or groove 18, the slot or groove sections 19 and 20 can extend entirely through the thickness of the side wall sections 11 and 12 or can extend only partially through such sections as shown in the preferred embodiment. With reference to FIGS. 1 and 4, the force exerting element 15 includes a main body portion 24 having a generally wedge-shaped or pie-shaped configuration. The element 15 also includes a curved force exerting surface 25 and a pair of handle support members 21, 21 extending upwardly from the main body portion 24 to support a handle 22. The handle 22 is retained between the support members 21, 21 by a pin member 36 (FIG. 4).

Figure 3:
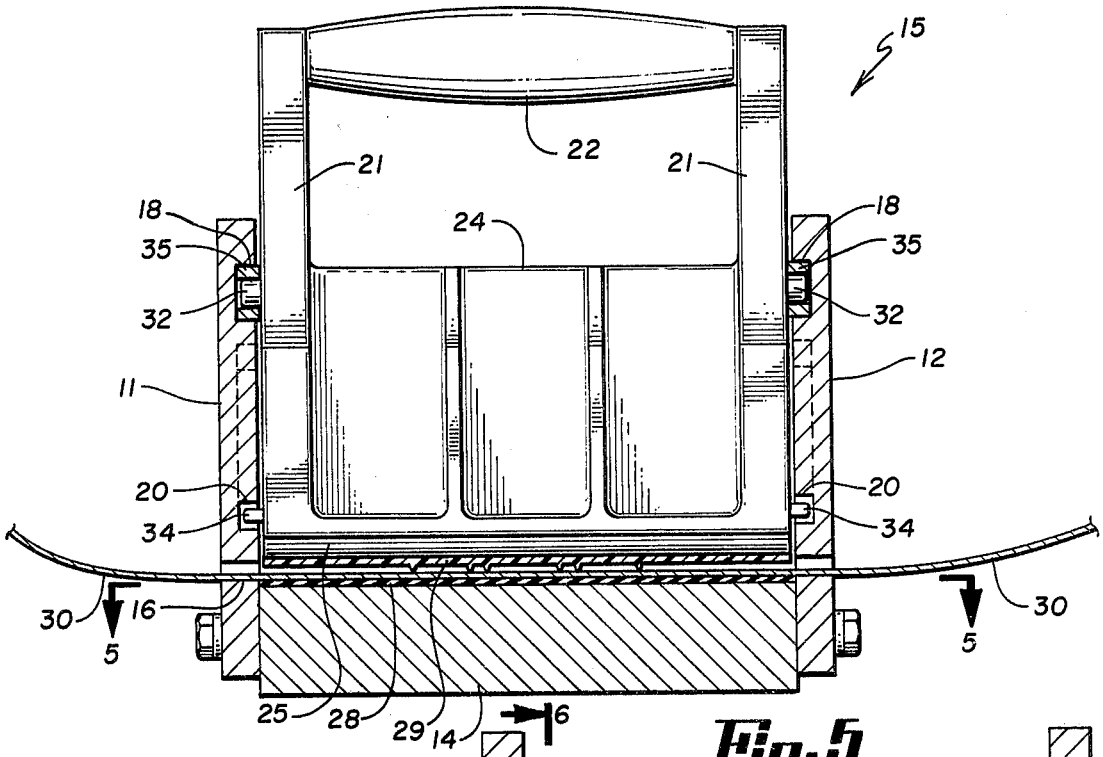
FIG. 3 is a front elevational view of the apparatus of the present invention, partially in section, showing the force exerting mechanism in its forwardmost force exerting position.

As illustrated best in FIGS. 3 and 4, a support pin 32 extends outwardly from each side of the element 15 to support a roller member 35. The roller members 35, 35 are supported in a conventional manner with respect to the support pins 32, 32 and are adapted for rolling movement in the guide slots 18, 18 in the side wall sections 11 and 12. Each side of the element 15 also includes a guide pin 34 extending outwardly from each side surface of the portion 24 and adapted for movement within the groove or slot sections 19 and 20 (FIG. 1). As shown best in FIG. 4, the curved force exerting surface 25 has a radius of curvature "R" with respect to the center point defined by the pins 32, 32. Also as illustrated in FIG. 4, the support members 21 extending upwardly from the body section 24 are disposed at angles "A" and "B" with respect to the rearward and forward surface portions of the section 24. In the preferred embodiment, as illustrated in FIGS. 1 and 3, portions of the force exerting element 15 can be hollowed out to minimize its weight.

The laminated tape utilized with the apparatus of the present invention can have a variety of structures. The structure contemplated by the present invention is a structure having at least two layers in which the upper layer is cut during operation of the appartus while the lower layer remains uncut. With such a structure, the cutout portions of the cut characters can then be lifted from the uncut layer and positioned onto a desired medium. In another embodiment of the laminated tape 30, the lamination can consist of an image carrying lower layer and a color carrying top layer in which a portion of the top layer is printed onto or transferred to the carrier layer during the force exertion operation of the present apparatus. With a laminated tape of this embodiment, the chip member 29 would have a raised surface defining the character to be printed rather than a cutting edge defining the outline of the character to be cut.

Figure 10:
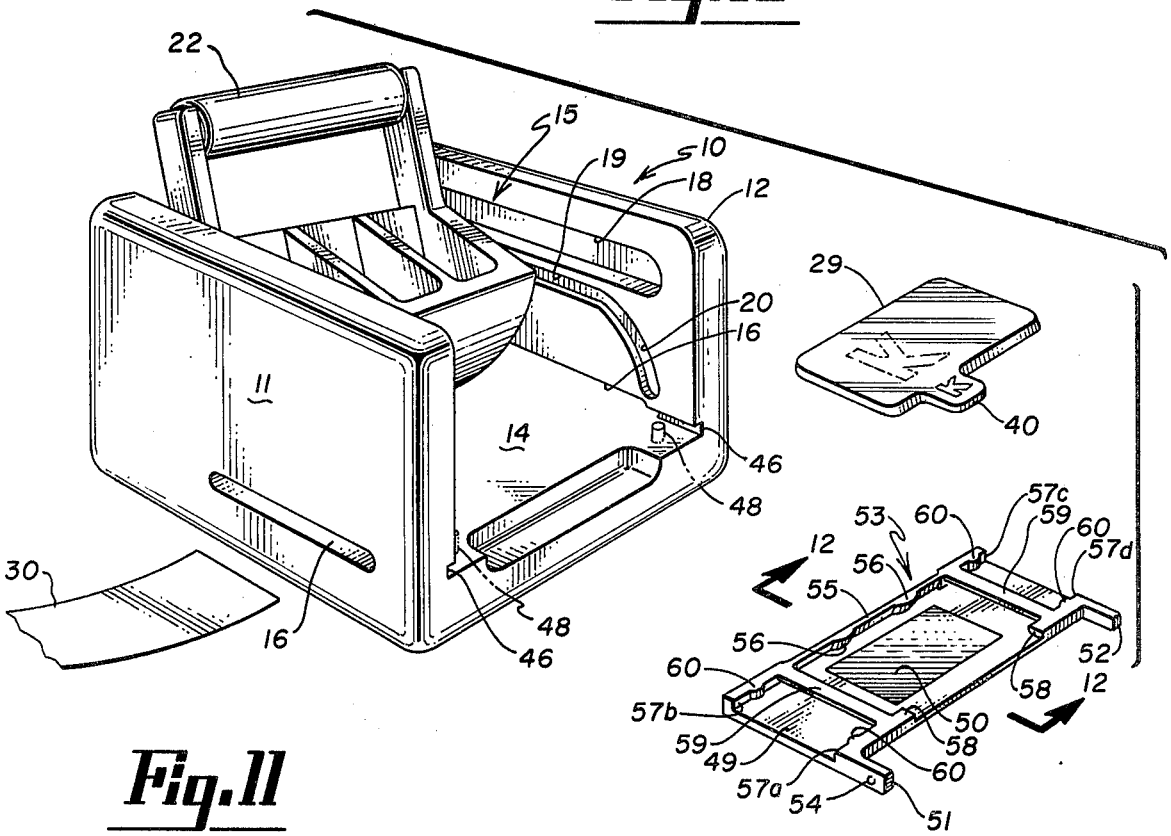
FIG. 10 is a pictorial view of the apparatus of the present invention showing an alternate embodiment of the means for guiding and aligning the laminated tape and for retaining and aligning the type chip.

FIGS. 10 through 14 illustrate two further embodiments of the means for guiding and aligning the laminated tape 30 with respect to the printing or cutting station and for retaining and aligning the printing chip 29. The first alternate embodiment is illustrated in FIG. 10 and includes a print plate 53 designed to be installed within the force exerting apparatus 10. The print plate 53 includes a relatively flat base portion 49, a pair of shoulder portions 57*a* and 57*d* entending upwardly from the forward edge of the base 49 and a pair of shoulder portions 57*b* and 57*c* entending upwardly from the rearward edge of the base 49. Each of these shoulders 57 (*a–d*) includes a tape guide protuberance 60 to assist in guiding and aligning the laminated tape 30. The base 49 also includes a print pad 50 embedded therein. The general characteristics and properties of this print pad 50 are similar to the print pad 28 described above and illustrated in FIGS. 1, 3, 5 and 6.

Extending between the rearward shoulders 57*b* and 57*c* along the rearward edge of the print plate 53 is an elongated chip retaining strip 55 joined at its ends to the shoulders 57*b* and 57*c*. The strip 55 is separated from and spaced above the base portion 29, thus permitting it to flex outwardly upon insertion of a chip 29. The actual relationship between the chip retaining strip 55 and the base 49 is illustrated best in FIGS. 10 and 12. A pair of bridging strip members 59, 59 are spaced above the base 49 and extend from the rearward shoulders 57*b* and 57*c* to the forward shoulders 57*a* and 57*d*, respectively, to assist in retaining the laminated printing or cutting ribbon 30 in close association to the base 49.

The print plate 53 is retained within the apparatus 10 by a pair of guide slots 46 positioned on the inside surface of each of the side walls 11 and 12. These guide slots 46 extend from the forward end of the apparatus 10 to a position rearwardly of the elongated tape slot 16. As shown best in FIG. 13, the slots 46 preclude lateral movement of the plate 53 within the apparatus 10. A pair of flexible arms 51 and 52 extend forwardly from the shoulder portions 57*a* and 57*d*, respectively, to assist in insertion and removal of the print plate 53. A protruding dimple 54 is disposed on the outer surfaces of each of the arms 51 and 52 for engagement with a corresponding recessed dimple 78 (FIG. 14) positioned in each of the guide slots 56. Engagement between the protruding dimples 54 and their respective recessed dimples 78 hold the print plate 53 in proper printing or cutting alignment with respect to the apparatus 10. It should be noted that different sizes of print plates 53 can be utilized to accommodate different widths of laminated tape.

The printing or cutting chip 29 is retained within the print plate 53 as a result of engagement between the front and rear edges of the chip 29 and corresponding front and rear edge portions of the print plate 53. These edge portions are defined by the forward shoulder portions 58, 58 and the protruding portions 56, 56 integrally formed with the strip 55. As illustrated best in FIG. 12, each of the protruding portions 56, 56 includes an edge portion 75 with a negative angle while each of the forward shoulder portions 58, 58 also includes a similarly angled edge 76. The angles of both of the edges 75 and 76 are negative draft angles to correspond with the positive draft angles of the forward and rearward edges of the chip 29. Thus, when the chip 29 is inserted into the print plate 53 with the rearward edge of the chip 29 in engagement with the edge 75 and the forward edge of the chip 29 engaging the edge 76, the chip 29 is retained in proper position within the print plate 53. To insert the chip 29, the rearward edge is forced against the edge 75 causing the chip retaining strip 55 to be flexed outwardly, thus permitting the forward edge of the chip 29 to be lowered for engagement with the edge 76. The chip is then retained within this position as a result of the flexing force of the strip 55 and the angled edges 75 and 76.

Figure 11:
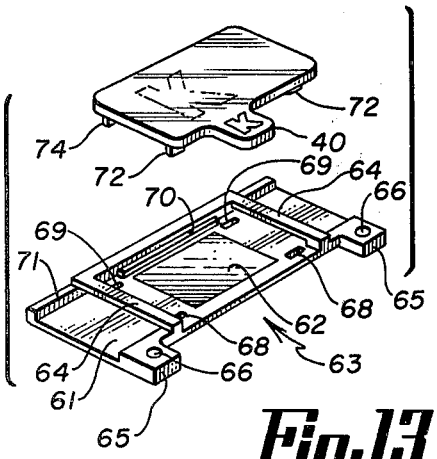
FIG. 11 is a pictorial view of a further embodiment of the means for guiding and aligning the laminated tape and for retaining and aligning the type chip.
Figure 12:
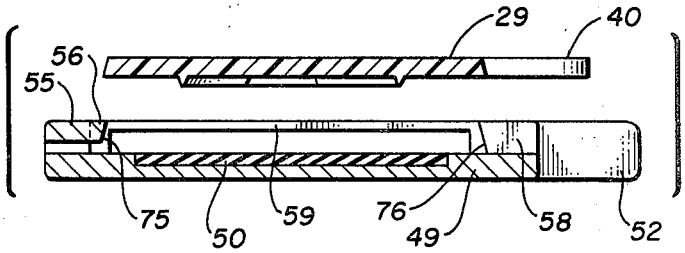
FIG. 12 is a view, partially in section, as viewed along the line 12—12 of FIG. 10 showing the operative relationship between the print plate of the embodiment shown in FIG. 10 and the type chip.
Figure 13:
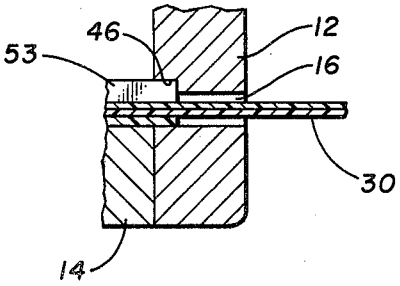
FIG. 13 is a view, partially in section, showing the means for retaining the print plate of FIG. 10.
Figure 14:
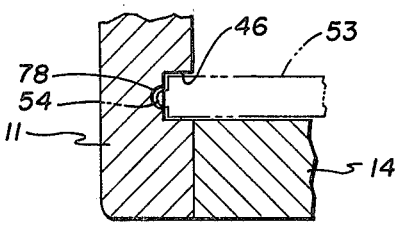
FIG. 14 is a view, partially in section, of a portion of the apparatus showing the means for securing the print plate to the apparatus side walls.

A further embodiment of the means for guiding and aligning the laminated tape 30 and for aligning and retaining the printing or cutting chip 29 is illustrated in FIG. 11. This alternate embodiment includes a print plate 63 having a relatively flat base portion 61. Embedded within this base portion is a print pad 62 similar to the print pad 50 of FIG. 10 and the print pad 28 of FIG. 1. An upwardly extending ridge 71 extends along the rearward edge of the base 61 and a pair of forward shoulder portions 65, 65 are positioned at the forward edge of the base 61. Each of the forward shoulder portions 65, 65 includes a hole 66 which is adapted for positioning over approximately positioned alignment posts in the base of the apparatus. In FIG. 10, such alignment posts are illustrated in phantom by the reference numerals 48, 48. The print plate 63 also includes a pair of bridge members 64, 64 extending from the rearward shoulder portion 71 to the forward shoulder portion 65, 65 to assist in retaining the tape 30 in close association with the base 61. As illustrated, the sections 64, 64 are spaced above the base 61 to allow passage of the multi-layer tape 30. The print plate 63 also includes a pair of forward openings 68, 68 and a pair of rearward openings 69, 69 to accept corresponding tabs or pins 72, 72 and 74, 74, respectively, of the chip 29. The bottom surface of the chip 29 includes a plurality of protruding tabs 72, 72 and 74, 74 which are designed to extend into the openings 68 and 69 to properly align and retain the chip 29 in a printing or cutting position. The protruding tabs 72, 72 and 74, 74 also function to guide the laminated tape 30 (FIG. 10) during its movement past the printing station. A shoulder 70 is associated with the base 61 to support the rearward edge of the chip 29 and to prevent the same from tipping during initial force exerting engagement between the element 15 (FIG. 10) and the chip 29.

Having described the structural details of the apparatus of the present invention, the operation can be understood as follows. First, a section of the elongated laminated tape 30 is aligned with the printing station. This is accomplished by inserting one end of the elongated section through the slot 16 in the side wall section 12 and out through the opposite slot 16 in the side wall section 11. If the tape aligning embodiments of either FIGS. 10 or 11 are utilized, the proper size of print plate (53 of FIG. 10 or 63 of FIG. 11) must first be selected and inserted into the apparatus 10. Then, in addition to threading the tape 30 through the slots 16, 16 it must also be guided beneath the bridging strip members (59, 59 of FIG. 10 and 64, 64 of FIG. 11). The laminated tape is then properly aligned with respect to the printing station. A chip 29 with the desired character is then selected and positioned over the laminated tape 31 into a properly aligned position. During the insertion of the laminated tape 30 and the chip 29, the force exerting element 15 is disposed in its rearwardmost position as illustrated by the solid lines in FIG. 7.

Following insertion of the tape 30 and the chip 29, the element 15 is manually moved forward toward the printing station. During initial forward movement, the roller 35 moves forwardly in the slot 18 and the pin 34 moves forwardly in the slot section 19. Because the slot 18 and the slot section 19 are parallel, this initial movement does not result in rolling movement of the element 15, but rather simple forward movement parallel to the printing station. The forwardmost position of this generally parallel movement of the element 15 is illustrated by the broken line 42 in FIG. 7. When the pin 34 engages the slot section 20, the element 15 commences rolling, force exerting movement with respect to the printing station. During this movement, the force exerting surface contacts the upper surface of the chip 29 in rolling, force exerting movement to transfer a printing or cutting force from the chip 29 to the laminated tape 30. The broken line 43 of FIG. 7 illustrates the position of the element 15 part way through its forward rolling or force exerting cycle. The forwardmost position of the element 15, indicated by the broken line 44, is defined by the forward end positions of the slots 18 and 20. When the roller 35 reaches the forward end of the slot 18 and the pin 34 reaches the forward end of the slot 20, the element 15 is still in force exerting engagement with the top surface of the chip 29. After this position is reached, the element 15 is manually moved rearwardly back to the position illustrated by the solid lines in FIG. 7 so that the element 15 is out of engagement with the chip 29 and the results of the printing or cutting can be viewed by the operator. The chip 29 is then removed and replaced by a chip corresponding to the next character desired to be printed or cut. When this is done, the tape 30 is advanced to a position for printing or cutting this next character, at which time the printing or cutting operation is repeated.

Although the description of the preferred embodiment has been quite specific, it is contemplated that various changes chould be made without deviating from the spirit of the present invention. Accordingly, it is intended that the scope of the present invention be dictated by the appended claims rather than by the description of the preferred embodiment.

I claim:

1. An apparatus for applying a printing or cutting force to an elongated strip of tape comprising:

a base;

means associated with said base including a generally flat printing or cutting surface for defining a printing or cutting station;

a pair of generally parallel side walls extending upwardly from said base, each of said side walls including a tape receiving opening in alignment with said printing or cutting station to define the path of travel of said elongated strip through said apparatus;

a printing or cutting member positionable in printing or cutting alignment with said printing or cutting station between said side walls; and force exerting means for exerting a printing or cutting force on said printing or cutting member including a force exerting member disposed between said side walls and having a curved force exerting surface with its center of curvature lying on an axis generally parallel to the path of travel of said elongated strip through said apparatus and perpendicular to said side walls and support and guide means for supporting and guiding said curved force exerting surface in movement between a first postion and a second position with at least a portion of said movement being generally rolling and force exerting movement with respect to said printing station.

2. The apparatus of claim 1 wherein a portion of said movement of said curved force exerting surface between a first position and a second position is non-rolling and non-force exerting movement.

3. The apparatus of claim 2 wherein said first position of said force exerting surface is a non-force exerting position and said second position of said force exerting surface is a force exerting position.

4. The apparatus of claim 3 wherein said support and guide means includes a first guide system comprising a first elongated groove in each of said side walls and a cooperating first bearing member connected with each side of said force exerting member and movable within said first elongated groove and a second guide system comprising a second elongated groove in each of said side walls and a cooperating second bearing member connected with each side of said force exerting member and movable within said second elongated groove.

5. The apparatus of claim 4 wherein said first elongated groove is generally parallel to said printing or cutting surface and said second elongated groove includes a first groove section for guiding said curved force exerting surface in non-rolling, non-force exerting movement between said first position and an intermediate position and a second groove section for guiding said curved force exerting surface in rolling and force exerting movement between said intermediate position and said second position.

6. The apparatus of claim 5 wherein said first groove section is generally parallel to said first elongated groove and said second groove section is curved with the curve being defined by the movement of a point on the respective side of said force exerting member during the rolling and force exerting movement of said force exerting surface.

7. The apparatus of claim 6 wherein each of said first bearing members includes a roller rotatably connected with its respective force exerting member side wall.

8. The apparatus of claim 7 wherein each of said second bearing members includes an outwardly extending pin connected with its respective force exerting member side wall.

9. The apparatus of claim 8 wherein the end of at least one of said first elongated groove and said second groove section defines said second position of said curved force exerting surface and the end of at least one of said first elongated groove and said first groove section defines said first position of said curved force exerting surface.

10. The apparatus of claim 1 wherein said force exerting member includes a pair of handle support members extending outwardly from said curved force exerting surface and a handle extending between said handle support members for manually moving said curved force exerting surface between said first and second positions.

11. The apparatus of claim 1 including alignment means for positioning said printing or cutting member in printing or cutting alignment with said printing or cutting station.

12. The apparatus of claim 11 wherein said alignment means includes a pair of pin members extending upwardly from said printing or cutting surface to define the aligned position of the rearward edge of said printing or cutting member.

13. The apparatus of claim 11 wherein said alignment means includes a ridge section extending upwardly from said printing or cutting surface to define the aligned position of the forward edge of said printing or cutting member.

14. The apparatus of claim 13 wherein said printing and cutting member is a generally flat, rectangular shaped member having a protruding tab portion and wherein said ridge section includes an opening to receive said tab portion.

15. The apparatus of claim 1 including a recessed portion near the forward edge of said base for facilitating the insertion and removal of said printing or cutting member.

16. The apparatus of claim 1 wherein said means for defining a printing station includes a selectively replaceable print plate comprising means for aligning and guiding said elongated strip of tape during movement thereof through said apparatus, means for retaining and aligning said printing or cutting member and means for securing said print plate to the apparatus.

17. The apparatus of claim 16 wherein said means for aligning and guiding said elongated strip of tape includes a plurality of shoulder portions positioned along the forward and rearward edges of said print plate.

18. The apparatus of claim 17 wherein said means for retaining and aligning said printing or cutting member includes a flexible strip extending along the rearward edge of said print plate and engageable with one edge of said printing or cutting member.

19. The apparatus of claim 18 wherein an inner edge of said flexible strip and an opposing inner edge along the forward edge of said print plate are beveled at negative angles and wherein the corresponding forward and rearward edges of said printing or cutting member are beveled so as to be retained by said beveled inner edges of said print plate.

20. The apparatus of claim 16 wherein said means for securing said print plate to said apparatus includes a groove in each of said side walls to slidingly receive opposite edges of said print plate.

21. The apparatus of claim 20 wherein said means for securing said print plate to said apparatus further includes a pair of flexible arms extending forwardly from said print plate and a protruding dimple on each of said arms for engagement with a corresponding recessed dimple in said side wall grooves.

22. The apparatus of claim 16 wherein said means for aligning and guiding said elongated strip of tape and for retaining and aligning said printing or cutting member includes a plurality of protruding pins on the lower surface of said printing or cutting member and a plurality of corresponding alignment openings in said print plate to receive said pins.

23. The apparatus of claim 22 wherein said pins and said alignment openings are positioned so as to permit the movement of said elongated strip of tape between at least two of said pins and alignment openings.

24. The apparatus of claim 16 wherein said means for securing said print plate to said apparatus includes a pair of retention posts disposed on said base and a pair of corresponding retention openings in said print plate.

* * * * *